US008811882B2

(12) United States Patent
Mitsuhashi et al.

(10) Patent No.: US 8,811,882 B2
(45) Date of Patent: Aug. 19, 2014

(54) IMAGE FORMING APPARATUS

(75) Inventors: Keisuke Mitsuhashi, Suntou-gun (JP); Michio Uchida, Susono (JP); Shoichi Zensai, Mishima (JP); Youhei Suzuki, Suntou-gun (JP); Tomonori Shida, Boise, ID (US); Takeshi Shinji, Suntou-gun (JP); Tomoaki Nakai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 637 days.

(21) Appl. No.: 12/429,997

(22) Filed: Apr. 24, 2009

(65) Prior Publication Data

US 2009/0269095 A1 Oct. 29, 2009

(30) Foreign Application Priority Data

Apr. 25, 2008 (JP) ..... 2008-115732

(51) Int. Cl.
*G03G 15/14* (2006.01)

(52) U.S. Cl.
USPC ..... 399/396; 399/388

(58) Field of Classification Search
USPC ..... 399/388, 396, 301
See application file for complete search history.

(56) References Cited

U.S. PATENT DOCUMENTS

| | | | | |
|---|---|---|---|---|
| 5,499,086 | A * | 3/1996 | Matsuno et al. | 399/313 |
| 6,356,735 | B1 | 3/2002 | Hozumi | |
| 2005/0074267 | A1 * | 4/2005 | Demchock et al. | 399/396 |
| 2006/0251452 | A1 * | 11/2006 | Isozaki | 399/388 |
| 2007/0008397 | A1 * | 1/2007 | Maebashi | 347/158 |
| 2007/0201893 | A1 * | 8/2007 | Yamazaki | 399/82 |

FOREIGN PATENT DOCUMENTS

| | | | |
|---|---|---|---|
| JP | 02282770 | A * | 11/1990 |
| JP | 04125676 | A * | 4/1992 |
| JP | 2004-45457 | | 2/2004 |
| JP | 2007-41582 | | 2/2007 |
| JP | 2007-52308 | | 3/2007 |
| JP | 2007-108562 | | 4/2007 |
| JP | 2008-046357 | A | 2/2008 |

* cited by examiner

*Primary Examiner* — Matthew G Marini
(74) *Attorney, Agent, or Firm* — Canon USA Inc IP Division

(57) ABSTRACT

The speed at which transfer-material enters a transfer region is controlled to prevent a phenomenon in which a toner image on an intermediate transfer belt is scraped by the leading edge of the transfer-material when the toner image is transferred onto the transfer-material. While the conveying speed of the transfer-material in a transfer nip coincides with the speed of the intermediate transfer belt, the transfer-material is conveyed at a speed lower than the peripheral speed of the intermediate transfer belt when the leading edge of the transfer-material comes into contact with the intermediate transfer belt, and the conveying speed of the transfer-material is increased by the time when the transfer-material enters the transfer nip.

11 Claims, 16 Drawing Sheets

IMAGE FORMING APPARATUS

BACKGROUND OF THE INVENTION

1. Field of the Invention

The present invention relates to an image forming apparatus using electrophotography, for example, a copying machine or a printer.

2. Description of the Related Art

In inkjet printers, so-called marginless printing is adopted popularly. In marginless printing, a transfer material, such as paper, which does not have a margin on its periphery is used, and an image is formed over the entire transfer material. In LBPs and so on using electrophotography, there is also an increasing demand for marginless printing. For example, Japanese Patent Laid-Open No. 2004-45457 proposes an image forming apparatus capable of marginless printing. In this image forming apparatus, a toner image larger than a transfer material is formed on an image bearing member, and part of the toner image is transferred onto the transfer material, thus achieving marginless printing.

When a toner image on an image bearing member, such as an intermediate transfer member, is transferred onto a transfer material, part of the toner image to be transferred is sometimes scraped off by a leading edge of the transfer material. In this case, the toner image that has been partly scraped off by the leading edge of the transfer material is transferred onto the transfer material. This phenomenon causes defective image forming near the leading edge of the transfer material. Here, defective image forming refers to soiling of the back side of the transfer material with toner, soiling of a leading end face of the transfer material with toner, or density unevenness at the leading edge of the transfer material.

When a margin is formed on the periphery of the transfer material, a toner image is not formed in a region on the image bearing member corresponding to the margin, and therefore, defective image forming rarely occurs.

In contrast, in marginless printing, since a toner image is formed over the entire transfer material, defective image forming occurs quite frequently. Further, although a toner image should be formed to the edges of the transfer material in marginless printing, part of the toner image near the edge is scraped off. Thus, defective image forming is more obvious in marginless printing.

SUMMARY OF THE INVENTION

The present invention prevents a phenomenon in which, during marginless printing for forming a toner image to edges of a transfer material, a toner image formed on an image bearing member so as to be transferred onto the transfer material is scraped by a leading edge of the transfer material.

An image forming apparatus according to an aspect of the present invention includes a rotatable image bearing member configured to bear a toner image; a transfer member configured to form a nip portion between the transfer member and the image bearing member; a guide member configured to guide a transfer material to an outer surface of the image bearing member on an upstream side of the nip portion in a rotating direction of the image bearing member; a conveying roller configured to convey the transfer material to the guide member; and a control device configured to control a speed of the conveying roller. The toner image on the image bearing member is transferred onto the transfer material in the nip portion by the transfer member. The image forming apparatus has a marginless print mode in which the toner image is formed on the image bearing member to a region on the image bearing member corresponding to a region outside the transfer material so as to be formed to an edge of the transfer material. When the toner image is formed at least at a leading edge of the transfer material in a conveying direction in the marginless print mode, the control device controls the speed of the conveying roller so that a speed of the transfer material when the leading edge of the transfer material comes into contact with the image bearing member is lower than a rotation speed of the image bearing member.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings. The dimensions, materials, shapes, and relative positions of the structural components described in the following exemplary embodiments are to be appropriately modified in accordance with the structure and various conditions of the apparatus to which the present invention is applied. Therefore, the following exemplary embodiments are not intended to limit the scope of the present invention, unless otherwise specified.

First Embodiment

Figure 1:
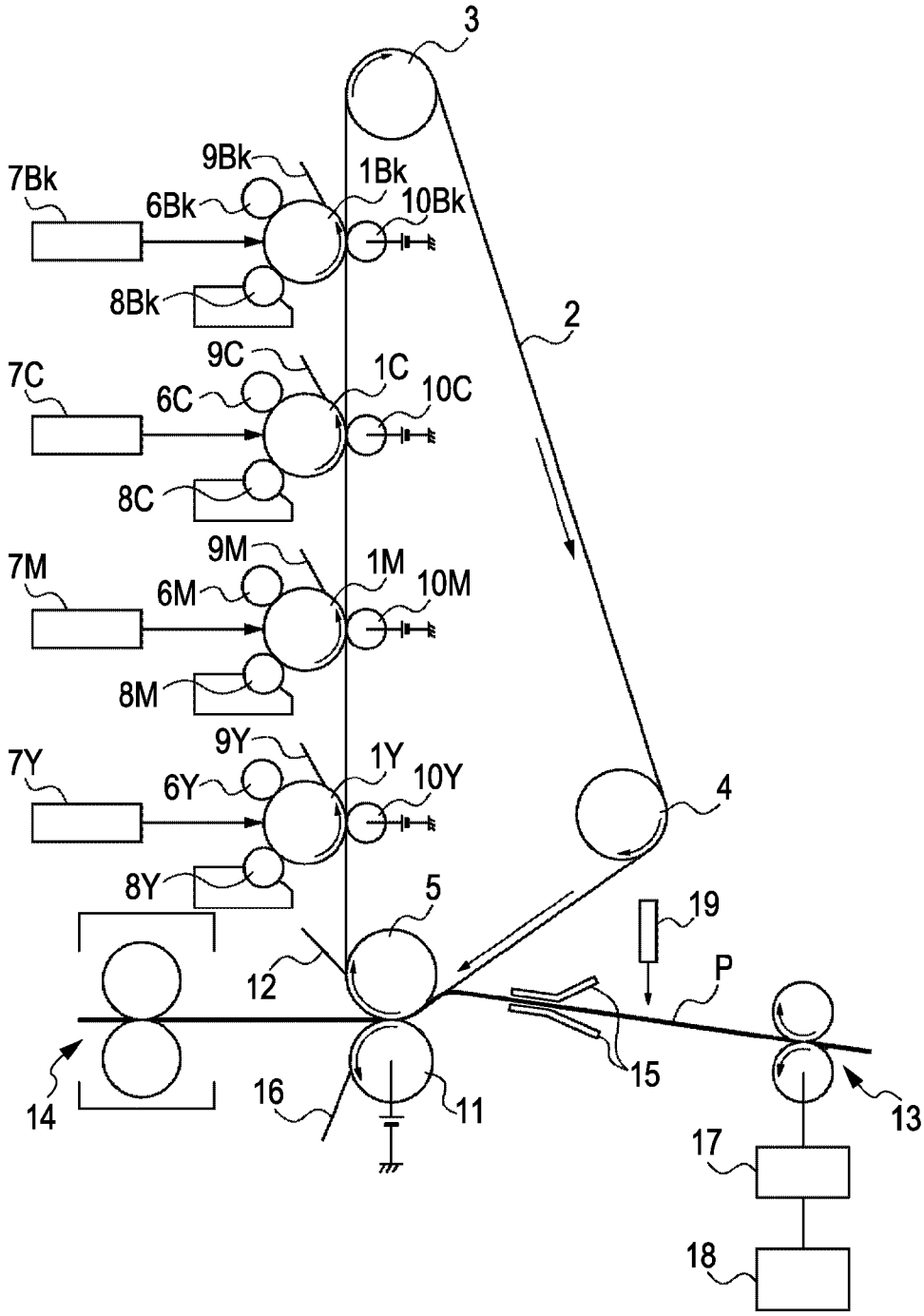
FIG. 1 is a schematic view of an image forming apparatus according to a first embodiment of the present invention.

FIG. 1 shows a configuration of an image forming apparatus according to a first embodiment of the present invention. The image forming apparatus shown in FIG. 1 includes a plurality of photosensitive members arranged in line corresponding to colors, and forms a color image by sequentially superimposing color toner images formed on the photosensitive members onto an intermediate transfer belt serving as an intermediate transfer member. The image forming apparatus includes photosensitive drums 1Y, 1M, 1C, and 1Bk formed by photosensitive members serving as first image bearing members, and an intermediate transfer belt 2 serving as a second image bearing member. The intermediate transfer belt 2 is an endless belt, which is stretched by a driving roller 3, a tension roller 4, and an opposing roller for secondary-transfer 5, and is movable in the direction of the arrows in FIG. 1. Image forming stations mainly including the photosensitive drums 1Y, 1M, 1C, and 1Bk are arranged in series in the moving direction of the intermediate transfer belt 2. Around the photosensitive drums 1Y, 1M, 1C, and 1Bk serving as photosensitive members, charging rollers 6Y, 6M, 6C, and 6Bk, exposure devices 7Y, 7M, 7C, and 7Bk, developing devices 8Y, 8M, 8C, and 8Bk, and drum cleaning devices 9Y, 9M, 9C, and 9Bk are arranged respectively. The developing devices 8Y, 8M, 8C, and 8Bk store yellow toner, magenta toner, cyan toner, and black toner, respectively.

The photosensitive drums 1Y, 1M, 1C, and 1Bk are rotated by driving devices (not shown) at a predetermined speed in the directions of the arrows in FIG. 1. Primary transfer rollers 10Y, 10M, 10C, and 10Bk are formed of sponge serving as an elastic material, and respectively oppose the photosensitive drums 1Y, 1M, 1C, and 1Bk with the intermediate transfer belt 2 disposed therebetween. A secondary transfer roller 11 serving as a transfer member opposes the opposing roller for secondary-transfer 5 with the intermediate transfer belt 2 disposed therebetween. A nip portion (secondary transfer nip) defined by the intermediate transfer belt 2 and the secondary transfer roller 11 forms a secondary transfer region. On an outer side of the intermediate transfer belt 2 and near the secondary transfer region, a belt cleaning device 12 is provided. The belt cleaning device 12 removes toner remaining on the surface of the intermediate transfer belt 2 after secondary transfer. A pair of registration rollers 13 serving as conveying rollers are provided upstream of the secondary transfer region in the conveying direction of a transfer material P, and a fixing device 14 is provided downstream of the secondary transfer region in the conveying direction.

The endless intermediate transfer belt 2 is rotated at a speed of 117 mm per second in the direction of the arrow while being stretched by the driving roller 3, the tension roller 4, and the opposing roller for secondary-transfer 5. The intermediate transfer belt 2 is formed of an electron conductive polyimide whose resistance is adjusted by carbon black. The intermediate transfer belt 2 has an electric resistivity of $1\times10^8$ Ω·cm, a thickness of 75 μm, an inner perimeter of 1116 mm, and a width of 350 mm in the longitudinal direction (direction orthogonal to the moving direction). The secondary transfer roller 11 is provided with a roller cleaning device 16 that removes and recovers toner remaining on the secondary transfer roller 11 after secondary transfer. The registration rollers 13 have a diameter of 17.4 mm. A surface of one of the rollers in contact with a front side (a side where transfer is performed) of the transfer material P is formed of resin having a surface roughness Ra of 6.3, and a surface of the other roller in contact with the back side of the transfer material P is formed of rubber having a frictional coefficient μ of 0.6. The registration rollers 13 are rotated in the directions of the arrows by a registration-roller driving unit 17. The driving speed of the driving unit 17 is controlled by a driving-speed control device 18. In other words, the speed of the conveying rollers is controlled by the driving-speed control device 18. Guides 15 before secondary transfer regulate the conveying path and attitude of the transfer material P so that the leading edge of the transfer material P enters the secondary transfer region after contacting the intermediate transfer belt 2, thus preventing defective image forming called "scattering" that will be described in detail below.

An image forming operation will now be described. When an image formation starting signal is issued, transfer materials P are fed out one by one, and conveyed to the registration rollers 13. In this case, the registration rollers 13 are stopped, and a leading edge of a conveyed transfer material P stands by just before the secondary transfer region. Subsequently, the registration rollers 13 start to rotate in synchronization with the start of image formation in the image forming stations including the photosensitive drums 1Y, 1M, 1C, and 1Bk, so that the transfer material P is conveyed to the secondary transfer region. In the image forming stations, when an image formation starting signal is issued, formation of toner images corresponding to the colors is started. Since image formation is performed through a similar procedure in the image forming stations, a description will be given of an image forming procedure performed in the image forming station including the photosensitive drum 1Y.

The photosensitive drum 1Y is uniformly charged at predetermined polarity and potential by the charging roller 6Y. Subsequently, an electrostatic latent image corresponding to a yellow color component image is formed on the photosensitive drum 1Y by the exposure device 7Y. Yellow toner adheres to the electrostatic latent image in the developing device 8Y, so that the electrostatic latent image is developed as a visible toner image. The toner image formed on the photosensitive drum 1Y is then transferred onto the intermediate transfer belt 2 in a primary transfer region by the primary transfer roller 10Y to which a primary transfer bias is applied. In this way, color toner images are sequentially transferred from the photosensitive drums 1Y, 1M, 1C, and 1Bk onto the intermediate transfer belt 2 through these processes, thus forming a full color toner image. In this case, toner remaining on the photosensitive drums 1Y, 1M, 1C, and 1Bk is removed and recovered by the drum cleaning devices 9Y, 9M, 9C, and 9Bk.

The full color toner image formed on the intermediate transfer belt 2 is conveyed to the secondary transfer region by the intermediate transfer belt 2. In this case, the transfer material P is conveyed by the registration rollers 13 so as to reach the secondary transfer region immediately before the full color toner image reaches the secondary transfer region. The conveying speed of the transfer material P is substantially equal to the rotation speed of the intermediate transfer belt 2. In the secondary transfer region, the full color toner image is transferred from the intermediate transfer belt 2 onto the transfer material P by the secondary transfer roller 11 (transfer member). Toner that is not transferred, but remains on the intermediate transfer belt 2 is removed and recovered by the belt cleaning device 12. Then, the transfer material P on which the full color toner image is formed is conveyed to the fixing device 14, where it is fixed.

Figure 15:
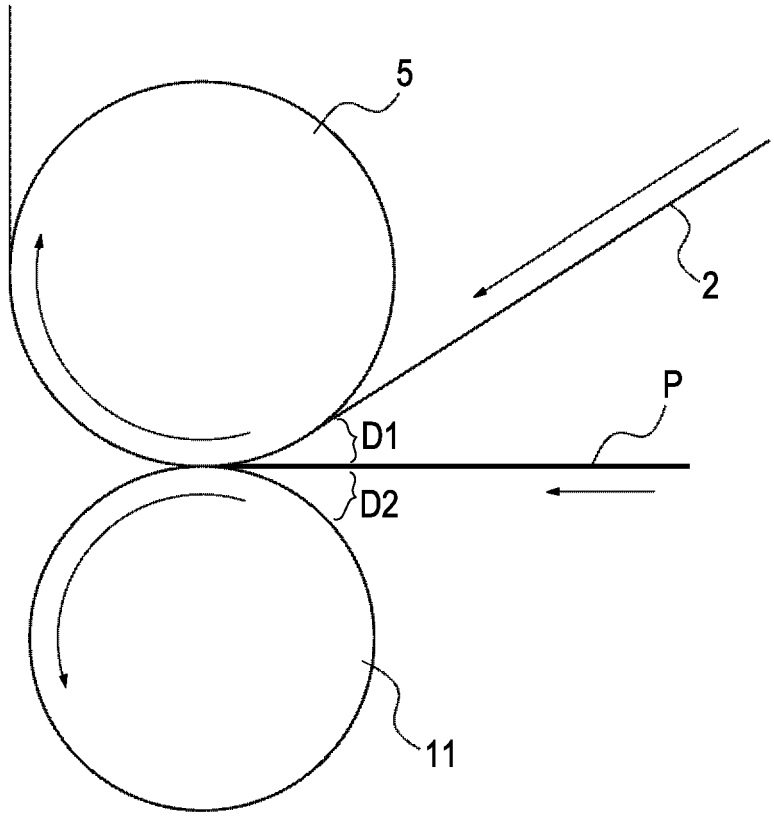
FIG. 15 illustrates the relationship between scattering and air gaps.
Figure 16:
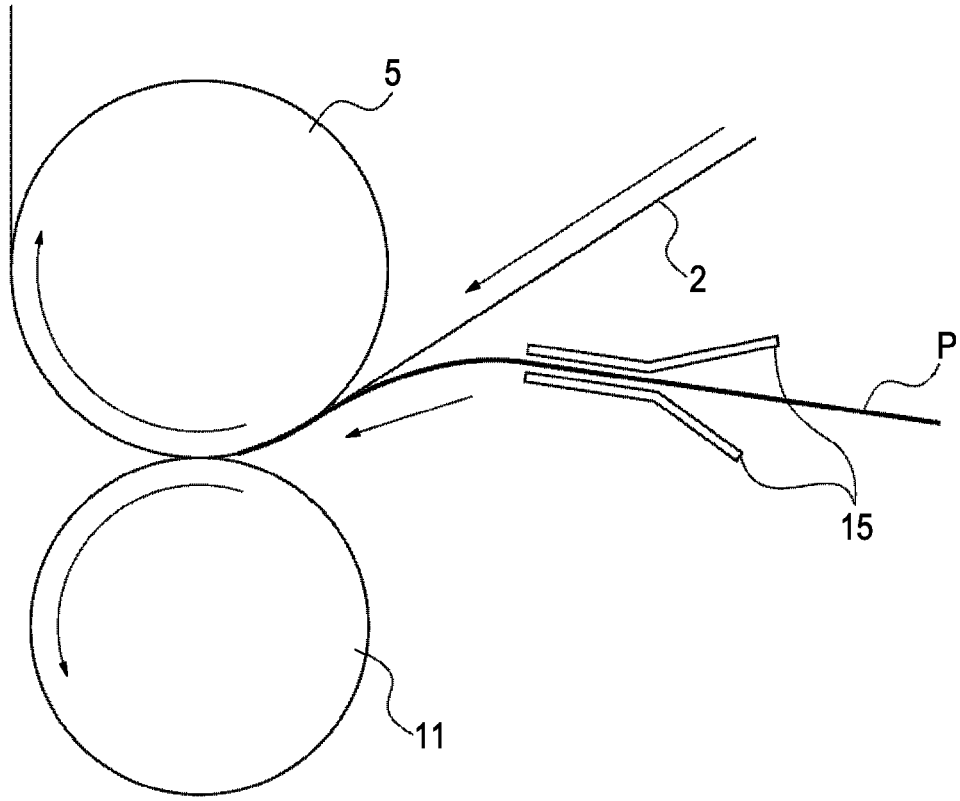
FIG. 16 illustrates the relationship between scattering and guides before secondary transfer.

The above-described term "scattering" refers to a phenomenon in which the position to which a toner image is transferred in secondary transfer is unstable. This phenomenon occurs because toner influenced by the voltage applied to the secondary transfer roller 11 is transferred via an air gap on the upstream side of the secondary transfer nip portion. FIG. 15 shows air gaps D1 and D2 corresponding to the positions where scattering occurs. When transferred via the air gap D1 on the upstream side of the secondary transfer nip portion, toner flies through the air gap D1, and the landing point of the toner on the transfer material P becomes unstable. To solve this problem, it is preferable that the air gap D1 be minimized and be shorter than the air gap D2. Accordingly, in the first embodiment, the conveying path and attitude of the transfer material P are regulated by the guides 15 in secondary transfer, as shown in FIG. 16, so that the leading edge of the transfer material P enters the secondary transfer region while being in contact with the intermediate transfer belt 2.

Marginless printing will now be described. The image forming apparatus of the first embodiment has a print mode for printing an image on a transfer material P having margins on the entire outer periphery, and a marginless print mode for printing an image to edges of a transfer material that includes at least one side having no margin.

Figure 2A:
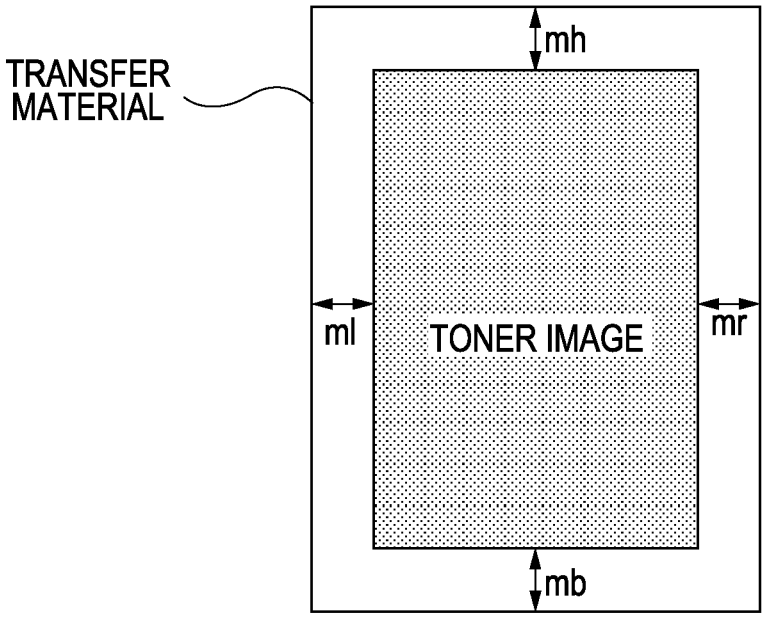
FIGS. 2A and 2B explain marginless printing and printing with a margin.
Figure 2B:
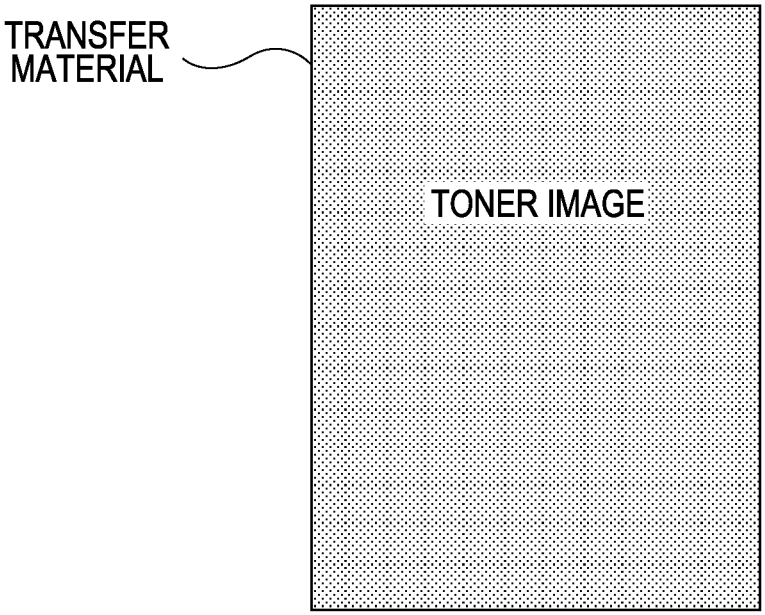

FIG. 2A shows printing with margins, and FIG. 2B shows marginless printing. In printing with margins, a toner image is entirely transferred in the transfer material P, and an upper margin (mh), a lower margin (mb), a left margin (ml), and a right margin (mr) are provided on the periphery of the transfer material P. In contrast, in marginless printing, a toner image reaches edges of the transfer material P, and there is no peripheral margin. While none of the upper, lower, left, and right margins are shown in FIG. 2B, marginless printing also includes a case in which a margin is not provided at any of the edges. Image formation in a marginless print mode will be described below.

Figure 3A:
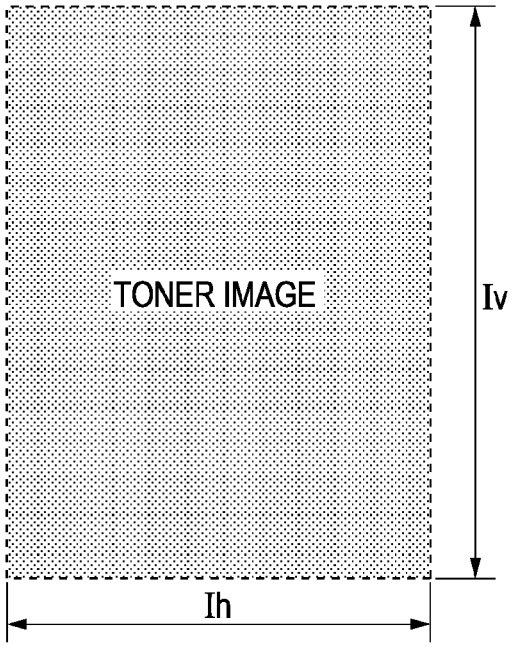
FIGS. 3A to 3C illustrate the relationship between a toner image and a transfer material in marginless printing.
Figure 3B:
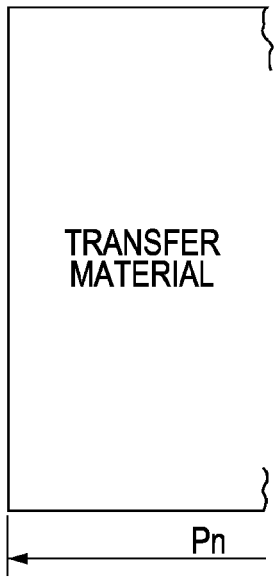
Figure 3C:
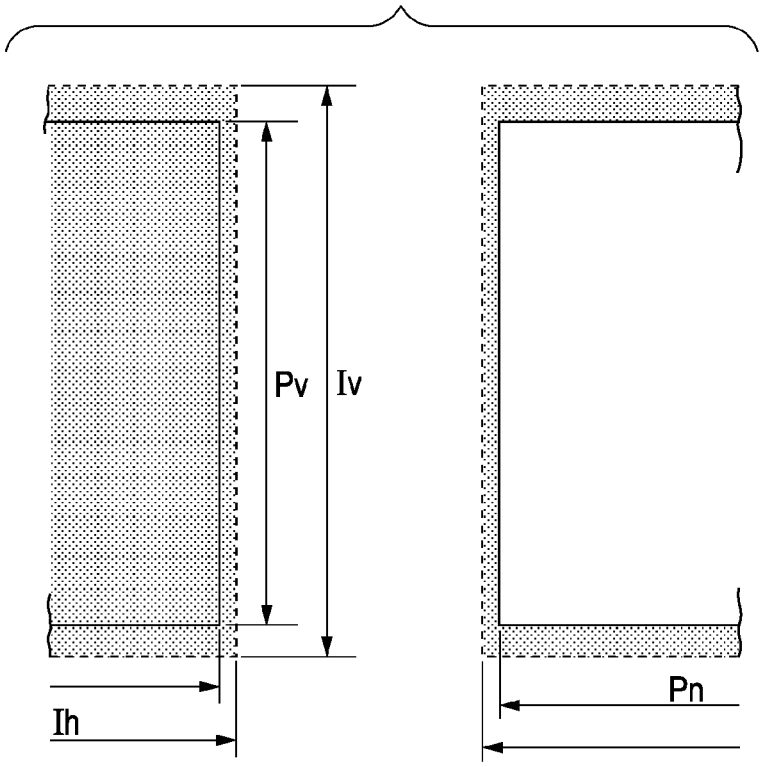

FIGS. 3A, 3B, and 3C explain toner image formation in marginless printing. FIG. 3A shows the size of a toner image formed on the intermediate transfer belt 2, and the toner image has a vertical size Iv and a horizontal size Ih. FIG. 3B shows the size of a transfer material P. The transfer material P has a vertical size Pv and a horizontal size Ph. The sizes of the toner image and the transfer material P are set so that $Pv<Iv$ and $Ph<Ih$. In other words, the size of the toner image is set to be slightly larger than the selected size of the transfer material P so that a margin is not formed in the transfer material P even when the transfer material P is supplied while slightly deviating in the front-rear or right-left direction. A toner image having a size $Iv\times Ih$, which is shown by a broken line, is formed on the intermediate transfer belt 2. The toner image is conveyed toward the secondary transfer region by the intermediate transfer belt 2. On the other hand, the conveyance timing of the transfer material P is controlled by the registration rollers 13, and the transfer material P is conveyed to the secondary transfer region in synchronization with the entry of the toner image into the secondary transfer region. That is, marginless printing is a mode in which a toner image is formed to reach a region on the intermediate transfer belt 2 corresponding to a region outside the transfer material P, and is formed to the edges of the transfer material P.

Figure 4:
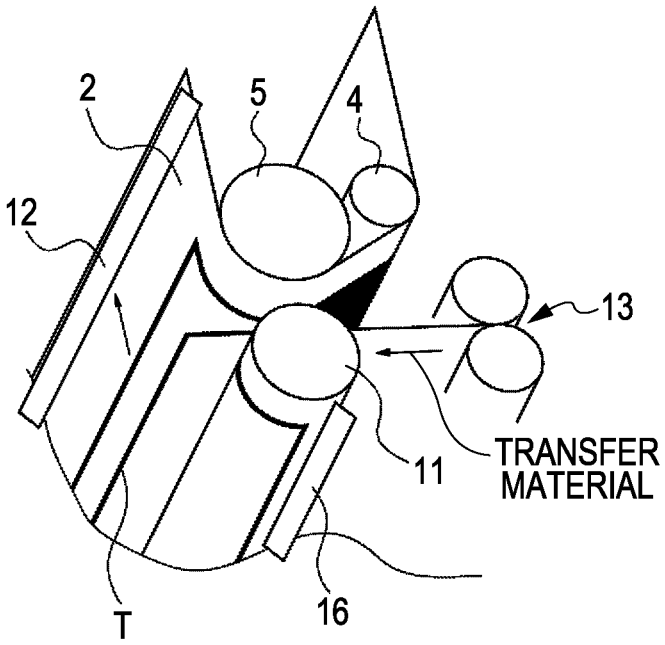
FIG. 4 explains secondary transfer in marginless printing.

In this case, since the size of the toner image is larger than the size of the transfer material P, the toner image on the intermediate transfer belt 2 comes into the secondary transfer region earlier than the transfer material P. Therefore, when the leading edge of the transfer material P comes into the secondary transfer region, it rubs against the intermediate transfer belt 2. This may disturb the toner image on the intermediate transfer belt 2, and may cause defective image forming. Rubbing and prevention thereof will be described below. In the secondary transfer region, the toner image having a size $Iv\times Ih$ is transferred onto the transfer material P. Thus, a toner image portion shaped like a frame, as shown in FIG. 3C, remains as secondary-transfer residual toner. Since the secondary-transfer residual toner is outside the edges of the transfer material P, it adheres to the secondary transfer roller 11 or remains on the intermediate transfer belt 2, as shown in FIG. 4. The toner adhering to the secondary transfer roller 11 moves onto the back side of the transfer material P during secondary transfer, and soils the back side. For this reason, in marginless printing, the toner adhering to the secondary transfer roller 11 is removed and recovered by the roller cleaning device 16.

Figure 5A:
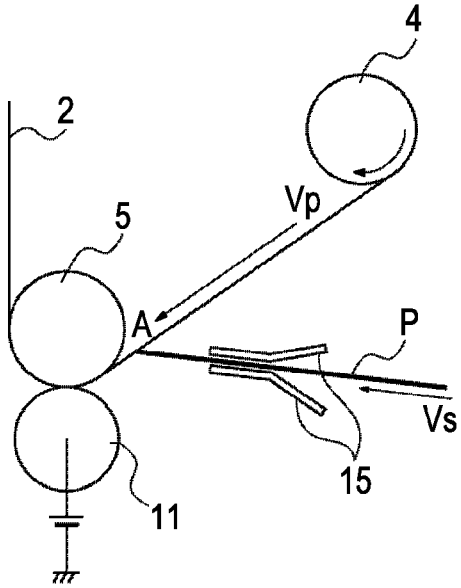
FIGS. 5A to 5D explains rubbing in the first embodiment.
Figure 5B:
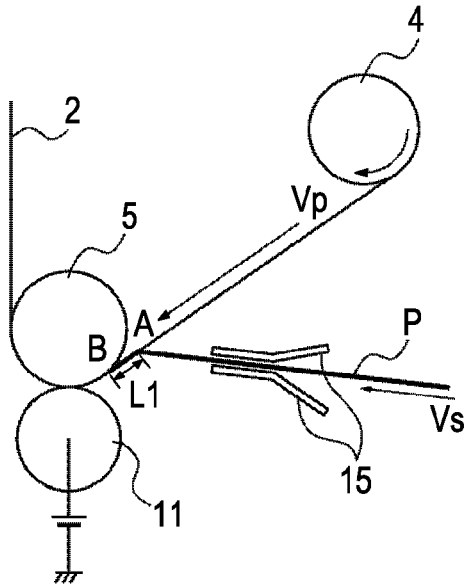
Figure 5C:
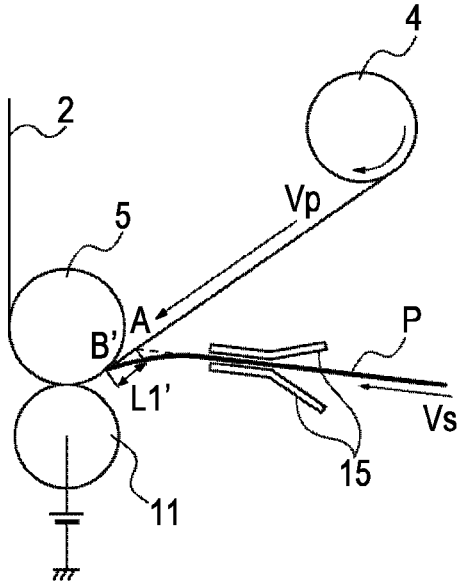
Figure 5D:
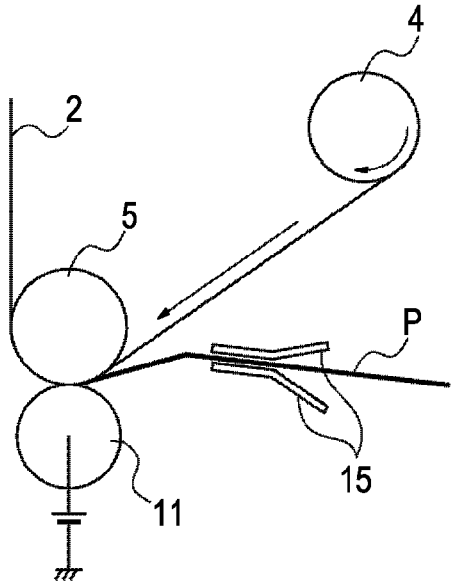

The reason for rubbing will now be described in detail. In the following description, a time when the leading edge of the transfer material P comes into contact with the intermediate transfer belt 2 is designated as T1 and a time when the leading edge of the transfer material P comes into the secondary transfer region is designated as T2. Further, a moving speed of the surface of the intermediate transfer belt 2 is designated as Vp and a speed at which the transfer material P is conveyed by the registration rollers 13 is designated as Vs. FIGS. 5A to 5D show states in which the transfer material P comes into the secondary transfer region in the image forming apparatus according to the first embodiment. FIG. 5A shows a state at the time T1, and FIGS. 5B and 5C show states at a time $T1+\Delta t$ when $\Delta t$ has passed from T1. FIG. 5D shows a state at the time T2. FIGS. 5B and 5C show the states at the same time before the time T2. FIG. 5B shows a case in which the transfer material P has no rigidity. In contrast, FIG. 5C shows a case in which the transfer material P has rigidity.

In FIG. 5A, a point A indicates a point where the leading edge of the transfer material P comes into contact with the intermediate transfer belt 2. In FIG. 5B, a point B indicates a point where the leading edge of the transfer material P is in contact with the intermediate transfer belt 2. A distance between the point A and the point B is designated as L1. Similarly, in FIG. 5C, a point B' indicates a point where the leading edge of the transfer material P is in contact with the intermediate transfer belt 2, and a distance between the point A and the point B' is designated as a distance L'. When $Vp=Vs$, if the transfer material P has no rigidity and is conveyed completely along the intermediate transfer belt 2, as shown in FIG. 5B, $L1=Vp\times\Delta t$. L1 refers to the distance for which the leading edge of the transfer material P moves in $\Delta t$, and $Vp\times\Delta t$ refers to the distance for which the surface of the intermediate transfer material P moves in $\Delta t$. In other words, in the case shown in FIG. 5B, the distance for which the leading edge of the transfer material P moves in $\Delta t$ is equal to the distance for which the surface of the intermediate transfer material P moves in $\Delta t$. Therefore, rubbing does not occur.

In actuality, however, since the transfer material P has rigidity, it is bent in a curve and is conveyed such that the leading edge thereof moves along the intermediate transfer belt 2, as shown in FIG. 5C. When $Vp=Vs$, as in the image forming apparatus of the related art, $L1'>L1$, that is, $L1'>Vp\times\Delta t$. Thus, since the distance for which the leading edge of the transfer material P moves in $\Delta t$ is longer than the distance for which the surface of the intermediate transfer material P moves in $\Delta t$, rubbing occurs so that the leading edge of the transfer material P scrapes the toner image on the intermediate transfer belt 2.

One conceivable cause for the above is that the force of the leading edge of the transfer material P, which obliquely contacts the intermediate transfer belt 2, acting toward the intermediate transfer belt 2 is regulated by the intermediate transfer belt 2. Since the force is regulated by the intermediate transfer belt 2, more force toward the secondary transfer region acts on the leading edge of the transfer material P. It is considered that this force and the rigidity of the transfer material P make the moving distance of the leading edge of the transfer material P on the intermediate transfer belt 2 longer than the moving distance of the surface of the intermediate transfer belt 2.

Accordingly, in the first embodiment, the speed Vs is controlled by the driving-speed control device 18 so as to prevent rubbing. When $Vp=Vs$, as in the image forming apparatus of the related art, $L1'>Vp\times\Delta t$ and rubbing occurs, as described above. Thus, L1' is reduced in the first embodiment. Since L1' can be reduced by decreasing Vs, Vs is made lower than Vp from the time T1 to the time T2. On the other hand, when L1'<Vp×Δt by decreasing Vs, rubbing occurs in the opposite direction. Therefore, it is preferable to set Vs so that L1' is substantially equal to Vp×Δt.

Figure 6:
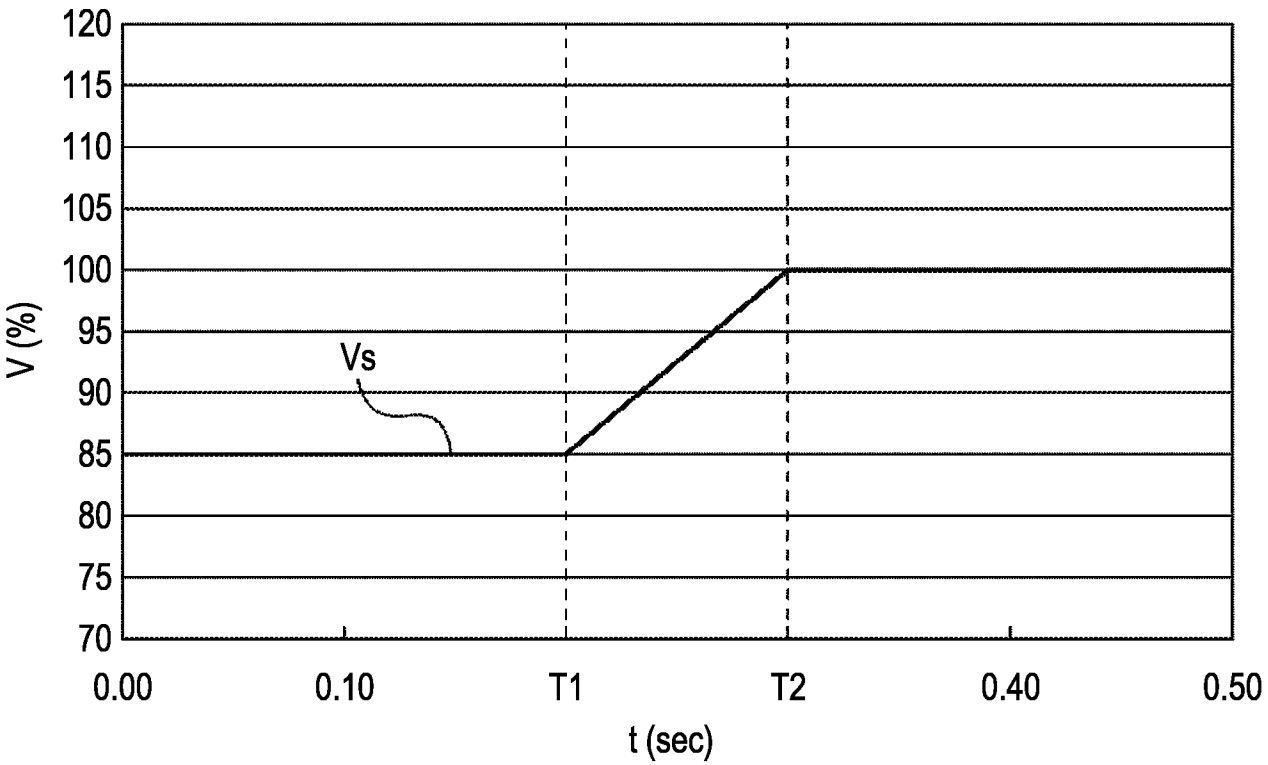
FIG. 6 shows the conveying speed of a transfer material in the first embodiment.

A description will now be given of how to control Vs in the first embodiment. FIG. 6 shows an example of control over Vs in the first embodiment, and control is performed so that Vs is lower than Vp from the time T1 to the time T2. In FIG. 6, the vertical axis indicates the ratio V of Vs and Vp, and V=(Vs/Vp)×100. The horizontal axis indicates the time t that has elapsed since the registration rollers 13 start to convey the transfer material P, and includes the time T1 and the time T2.

First, the driving-speed control device 18 controls the driving unit 17 to control the speed of the registration rollers 13 so that Vs at the time T1 becomes about 85% of Vp (about 99.5 mm/sec). In this case, the time T1 is determined on the basis of the time counted from the time when the registration rollers 13 start to convey the transfer material P. Subsequently, the driving-speed control device 18 controls the driving unit 17 so that Vs monotonously increases from the time T1 to the time T2, and becomes substantially equal to Vp at the time T2. After the time T2, the driving-speed control device 18 controls the driving unit 17 so that Vs is kept substantially equal to Vp (about 117 mm/sec). The time T2 is determined on the basis of time counting similar to the time T1.

After the time T2, secondary transfer from the intermediate transfer belt 2 onto the transfer material P is started at the secondary transfer nip portion. Since the toner image to be transferred onto the transfer material P is contracted when Vs<Vp, Vs and Vp are made equal. As described above, rubbing is prevented by controlling the conveying speed of the transfer material P.

In this way, in the first embodiment, the toner image is transferred onto the transfer material P without causing defective image forming even in marginless printing. As described above, the first embodiment can prevent rubbing of the leading edge of the transfer material P against the intermediate transfer belt 2 in marginless printing, and can obtain a print image without causing defective image forming at the leading edge of the transfer material P. Moreover, defective image forming due to rubbing can be prevented without greatly changing the configuration from that of the image forming apparatus of the related art.

Figure 7:
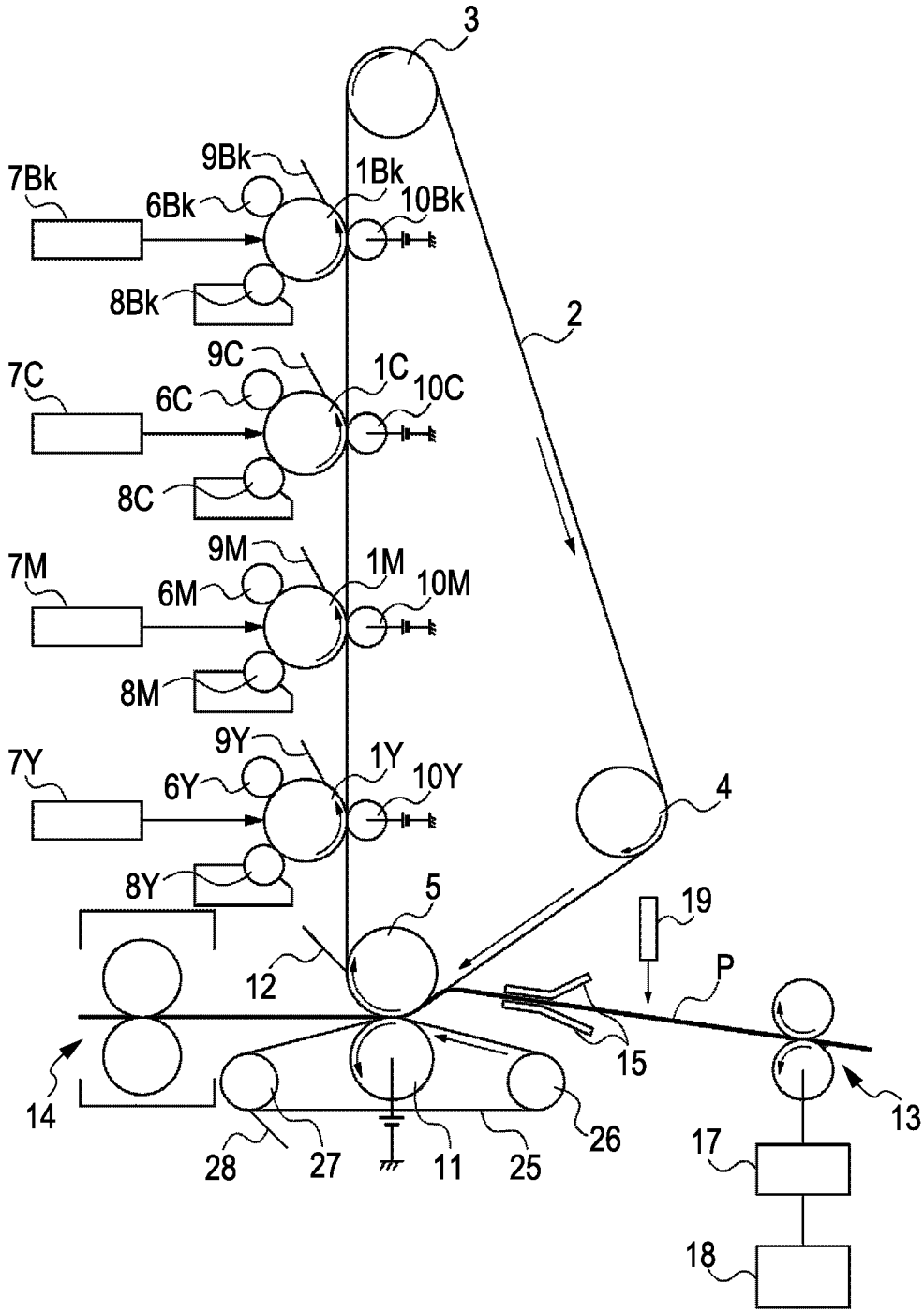
FIG. 7 shows an image forming apparatus in which a secondary transfer member is shaped like a belt.

While the secondary transfer member is shaped like a roller in the first embodiment, similar advantages can be obtained, regardless of the shape of the secondary transfer member, as long as a difference is formed between the speed of the leading edge of the transfer material and the speed of the intermediate transfer belt 2 on the upstream side of the secondary transfer region. FIG. 7 shows an example of an image forming apparatus to which the first embodiment can be applied and in which the secondary transfer member is shaped like a belt. A secondary transfer belt 25 is stretched by a secondary-transfer-belt driving roller 26 and a tension roller 27, and rotates in the direction of the arrow at the same speed as that of an intermediate transfer belt 2. The secondary transfer belt 25 is provided with a belt cleaning device 28 for removing and recovering toner adhering to the secondary transfer belt 25.

Second Embodiment

Figure 8:
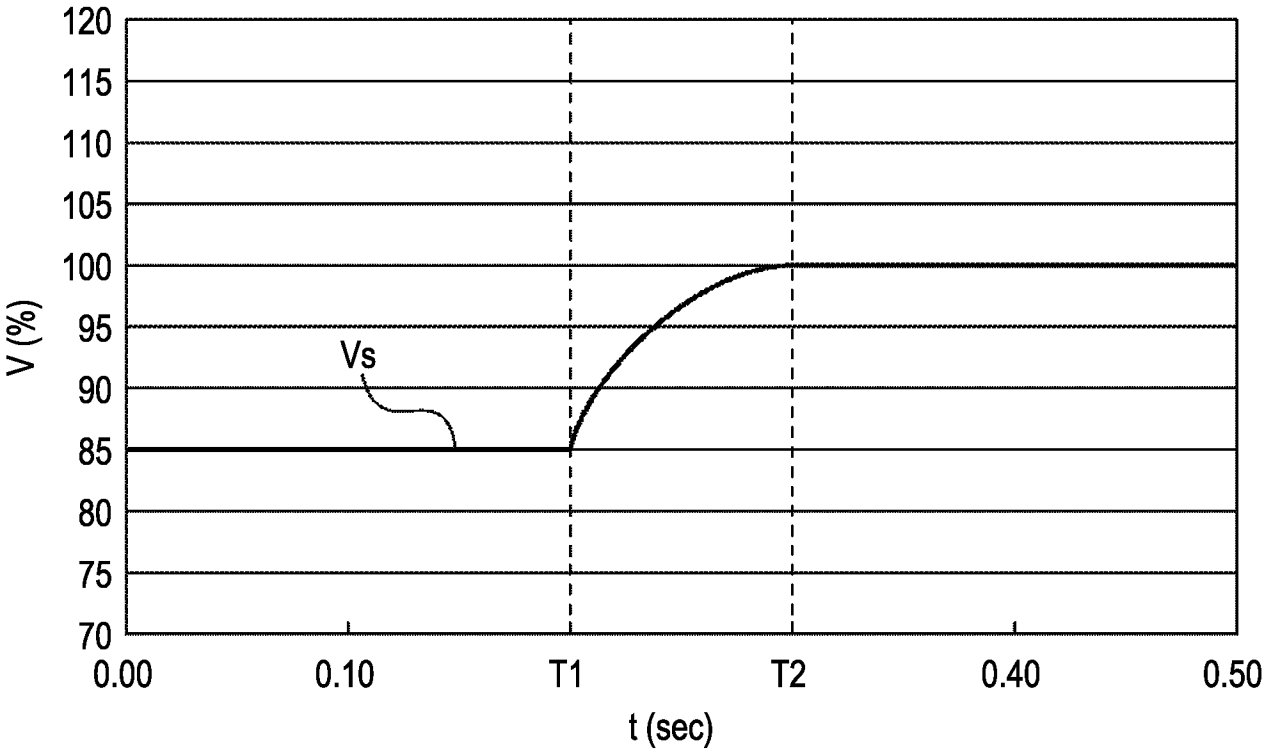
FIG. 8 shows the conveying speed of a transfer material in a second embodiment.

A configuration and an image forming operation of an image forming apparatus according to a second embodiment are substantially identical to those adopted in the image forming apparatus of the first embodiment. Therefore, components having functions similar to those in the image forming apparatus of the first embodiment are denoted by the same reference numerals, and descriptions thereof are omitted. In the following, structures different from those in the image forming apparatus of the first embodiment will be described chiefly. FIG. 8 shows the control over the conveying speed of a transfer material P in the second embodiment. Notes in FIG. 8 are similar to those in FIG. 6.

A driving-speed control device 18 controls a driving unit 17 so that Vs at a time T1 becomes about 85% of Vp (about 99.5 mm/sec). The time T1 is determined on the basis of time counting similar to that adopted in the first embodiment. Subsequently, the driving-speed control device 18 controls the driving unit 17 to control the speed of registration rollers 13 so that Vs increases from the time T1 to a time T2. In this case, when a midpoint between T1 and T2 is set at T3, the driving unit 17 is controlled so that the amount of increase in Vs from T1 to T3 is larger than the amount of increase in Vs from T3 to T2. After the time T2, the driving-speed control device 18 controls the driving unit 17 so that Vs is equal to Vp (about 117 mm/sec). The time T2 is determined on the basis of time counting similar to that adopted in the first embodiment.

Figure 9A:
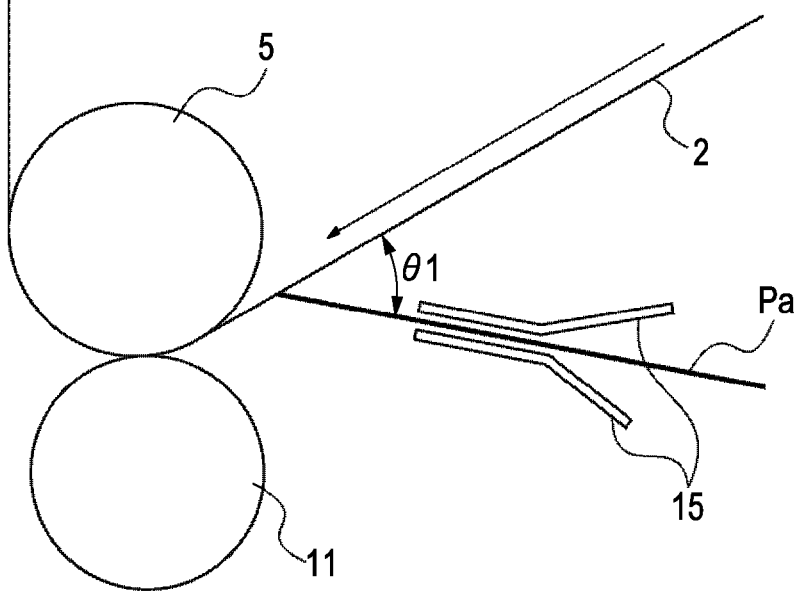
FIGS. 9A and 9B explain a state in which a transfer material enters a secondary transfer region.
Figure 9B:
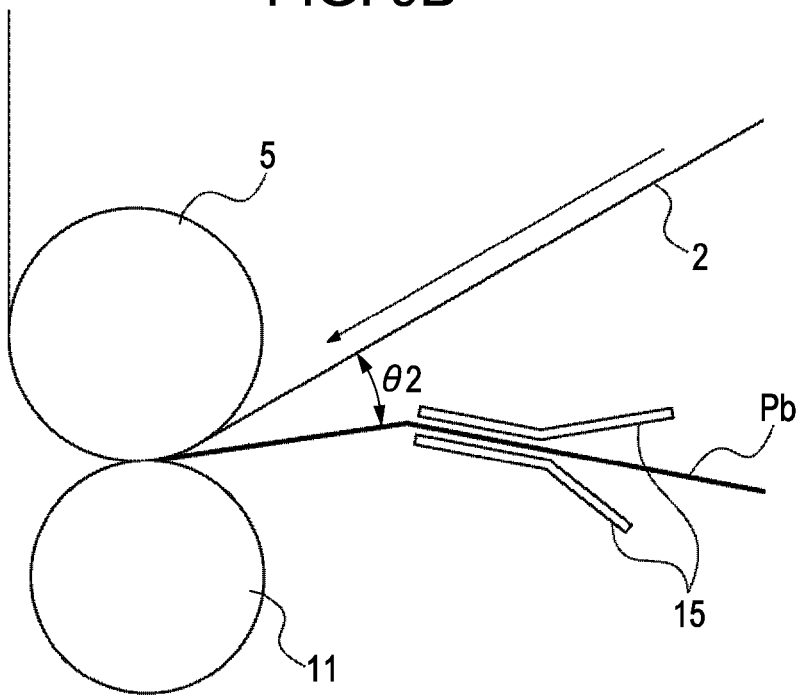

A description will now be given of the control over the conveying speed of the transfer material P from the time T1 to the time T2 in FIG. 6. FIGS. 9A and 9B show states in which the transfer material P enters a secondary transfer region in the image forming apparatus of the second embodiment. For concise explanation, bending of the transfer material P is ignored. Pa in FIG. 9A shows a transfer material at the time T1, and Pb in FIG. 9B shows a transfer material at the time T2. θ1 and θ2 represent the angles between the transfer materials Pa and Pb and the intermediate transfer belt 2 at the times T1 and T2, respectively. As shown in FIGS. 9A and 9B, the angle between the transfer material and the intermediate transfer belt 2 decreases from the time T1 to the time T2. The change of the angle with time means that the condition of Vs for preventing rubbing changes with time. As the angle θ between the transfer material and the intermediate transfer belt 2 decreases, a component (Vs cos θ) of the transfer material pointing toward the secondary transfer region increases. Accordingly, in the second embodiment, Vs is controlled so that L1' is closer to Vp×Δt even when the angle changes.

Figure 10:
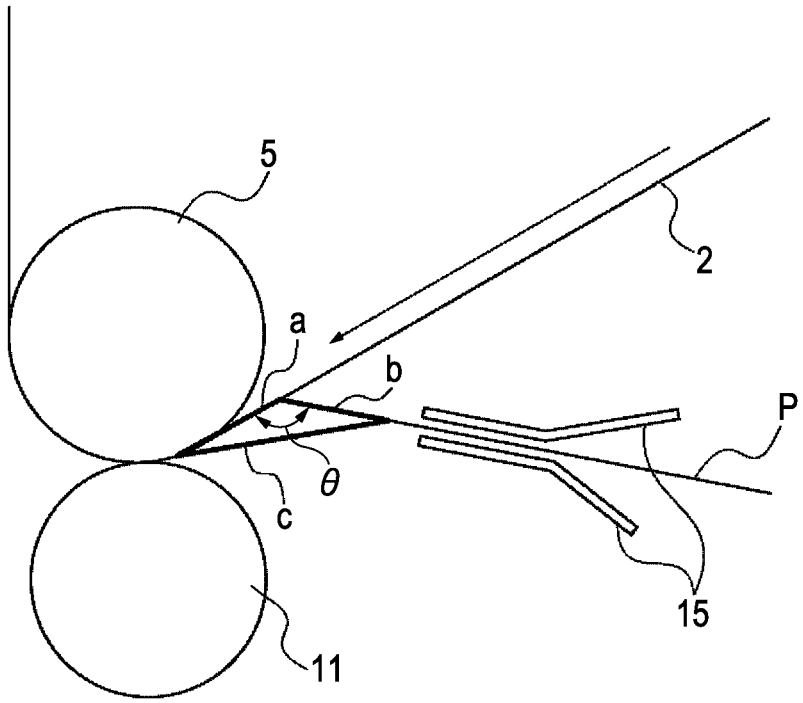
FIG. 10 is a model diagram showing how to control the conveying speed of the transfer material in the second embodiment.

FIG. 10 is used to calculate the conveying speed of the transfer material P when the advantages of the second embodiment are certified. The transfer materials Pa and Pb are combined as P. Further, bending of the transfer material is ignored for concise explanation. In FIG. 10, a, b, and c respectively represent the lengths of sides of a triangle defined by the intermediate transfer belt 2 and the transfer materials Pa and Pb in FIG. 8, and θ represents the angle between the sides a and b. When it is assumed that L3 represents the moving distance of the leading edge of the transfer material P from the time T1 to the time T2 and that Equation L3=Vp×Δt (=a) always holds, Vs is controlled between T1 and T2 so as to meet the following equation:

$$\Delta t \cdot Vt2+(2b/Vp)V-\Delta t+(2b/Vp)\cos\theta=0$$

Similarly, (Vs/Vp)×100=V. Therefore, it is considered that rubbing can be prevented by changing V from the time T1 to the time T2, as shown in FIG. 8. Here, Vt1 represents the speed of the transfer material when the leading edge of the transfer material comes into contact with the image bearing member, and Vt2 represents the speed of the transfer material when the leading edge of the transfer material comes into the nip portion.

As a result of verification of the advantages of the second embodiment using an actual image forming apparatus, rubbing was not visually detected, and the advantages of the second embodiment could be proved. During verification, the rotation speed of the registration rollers 13 was changed every 2 msec in order to control the conveying speed of the transfer material P in a manner similar to the equation. In actuality, the advantages of the second embodiment were observed while changing Vs stepwise at a small interval. This verification proved that rubbing could be prevented by controlling Vs according to the equation. However, not only the equation, but also the following two points are important in the second embodiment.

The first point is to control Vs so that Vs increases with time from the time T1 to the time T2. The second point is to perform control so that the amount of increase in Vs from the time T1 to the time T3 serving as the midpoint between T1 and T2 is larger than the amount of increase in Vs from the time T3 to the time T2. When Vt3 represents the speed of the transfer material the time T3 ((T1+T2)/2), Vt2>Vt3>(Vt1+Vt2)/2.

Because of the above two points, rubbing can be more effectively prevented than in the first embodiment. While the secondary transfer member in the image forming apparatus of the second embodiment is shaped like a roller, similar advantages can be obtained, regardless of the shape of the secondary transfer member, as long as a difference is formed between the speed of the leading edge of the transfer material and the speed of the intermediate transfer belt 2 on the upstream side of the secondary transfer region, in a manner similar to that adopted in the first embodiment.

Third Embodiment

A configuration and an image forming operation of an image forming apparatus according to a third embodiment are substantially identical to those adopted in the image forming apparatus of the first embodiment. Therefore, components having functions similar to those in the image forming apparatus of the first embodiment are denoted by the same reference numerals, and descriptions thereof are omitted. In the following, structures different from those in the image forming apparatus of the first embodiment will be described chiefly.

Figure 11:
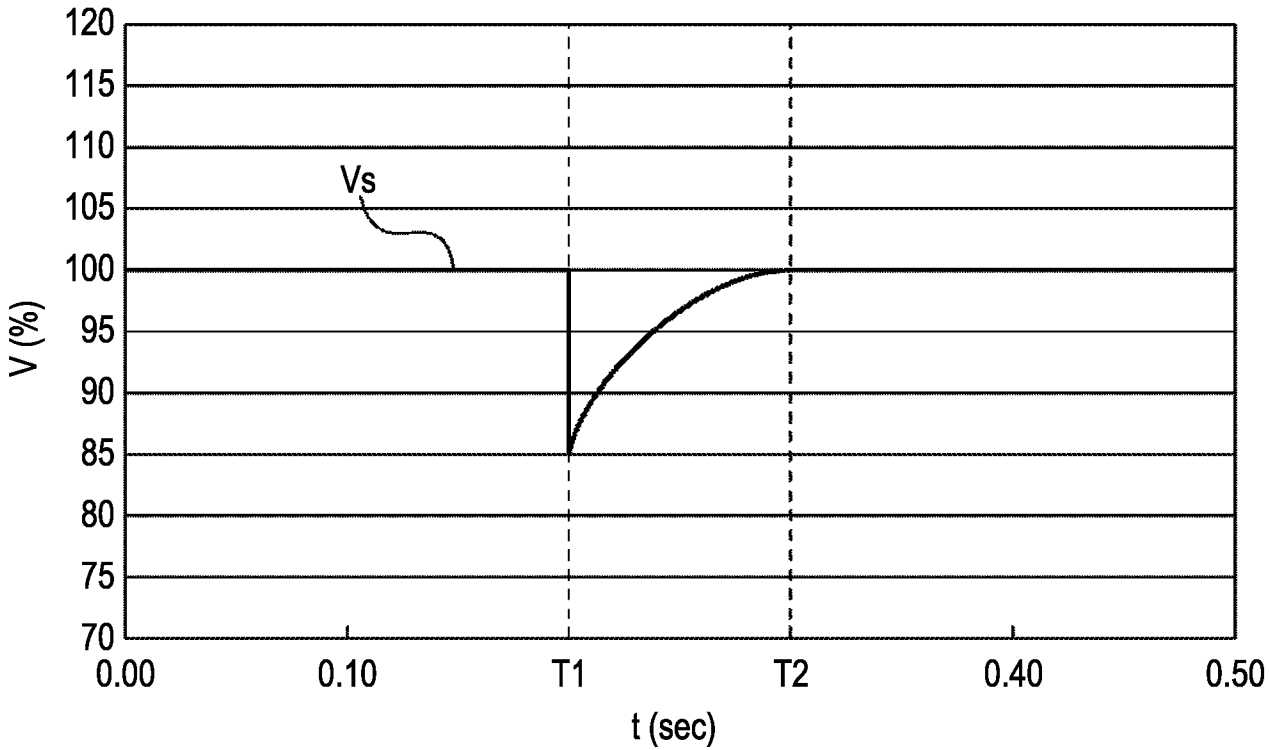
FIG. 11 shows the conveying speed of a transfer material in a third embodiment.

FIG. 11 shows how to control the conveying speed of a transfer material P in the third embodiment. Control is performed so that the conveying speed Vs of the transfer material P before the leading edge of the transfer material P comes into contact with the image bearing member is higher than after the time T1.

To prevent rubbing, it is necessary to control Vs after the time T1. On the other hand, Vs before the time T1 is arbitrary to some extent. Accordingly, in the third embodiment, the conveying speed Vs of the transfer material P before the leading edge of the transfer material comes into contact with the image bearing member is increased, and the same control as in the first or second embodiment is exerted over Vs after the time T1. As a result, the time from when the registration rollers 13 start to convey the transfer material P to when the leading edge of the transfer material P comes into contact with the intermediate transfer belt 2 is shorter than in the first and second embodiments. This can make the print time for one material shorter than in the first and second embodiments.

Fourth Embodiment

A configuration and an image forming operation of an image forming apparatus according to a fourth embodiment are substantially identical to those adopted in the image forming apparatus of the first embodiment. Therefore, components having functions similar to those in the image forming apparatus of the first embodiment are denoted by the same reference numerals, and descriptions thereof are omitted.

In the first, second, and third embodiments, the optimal speed Vs between the time T1 and the time T2 differs according to the type of the transfer material and the surrounding environment of the transfer material. If the type and environment of the transfer material in marginless printing are known beforehand, the speed Vs can be controlled more properly. The optimal speed Vs differs according to the type and environment of the transfer material because the degree of bending of the transfer material varies in accordance with these conditions. For example, a thin transfer material greatly bends because its rigidity is low. In contrast, a thick transfer material does not greatly bend because its rigidity is high. Further, since the rigidity of the transfer material decreases in a high-temperature high-humidity environment, the transfer material bends greatly.

Figure 12:
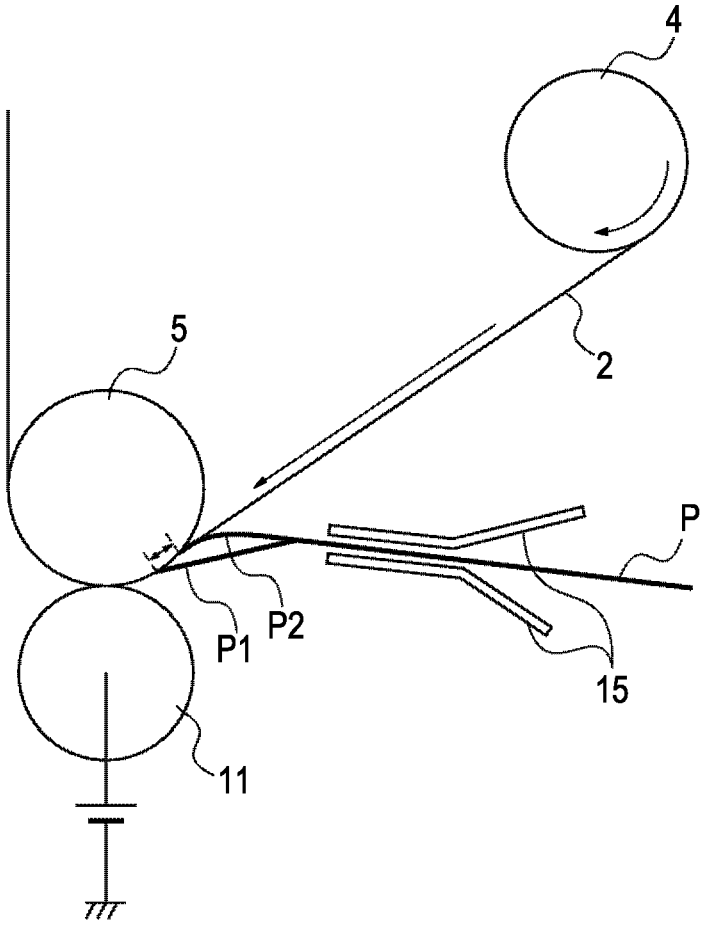
FIG. 12 explains the influence of bending of a transfer material in a fourth embodiment.

FIG. 12 shows the influence of bending of the transfer material. In FIG. 12, P1 represents a transfer material that does not bend greatly, and P2 represents a transfer material that bends greatly. As shown in the figure, the speed at which the leading edge of the transfer material that greatly bends moves toward the secondary transfer region is lower than that of the transfer material that does not bend greatly. Hence, the optimal speed Vs of a thin transfer material that greatly bends is higher than that of a thick transfer material that rarely bends. Accordingly, in the fourth embodiment, rubbing is more accurately prevented by correcting the control over Vs in the first or second embodiment, in accordance with the type and environment of the transfer material.

Figure 13:
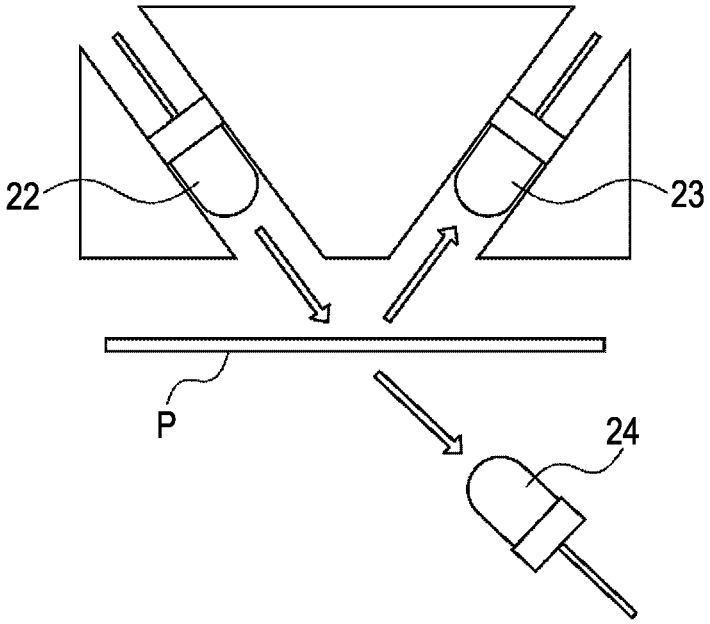
FIG. 13 illustrates an example of a structure of a media sensor in the fourth embodiment.

First, the type of the transfer material is detected with a media sensor 12 serving as a device for detecting the thickness of the transfer material, and the surrounding environment of the transfer material is detected with an environment sensor (not shown). FIG. 13 shows an example of a structure of a media sensor. The media sensor shown in FIG. 13 includes an infrared light emitting diode 22 serving as a light emitting element and phototransistors 23 and 24 serving as light receiving elements. The phototransistor 23 detects light that is emitted from the infrared light emitting diode 22 and is reflected by the transfer material P. The intensity of reflected light detected by the phototransistor 23 differs according to the surface roughness of the transfer material P. The phototransistor 24 detects light that is emitted from the infrared light emitting diode 22 and is transmitted through the transfer material P. The intensity of transmitted light detected by the phototransistor 24 differs according to the thickness of the transfer material P. On the basis of information about the surface roughness and thickness of the transfer material P detected by the media sensor 12, the type of the transfer material P is estimated.

The environment sensor includes a temperature sensor and a humidity sensor, and is placed at an arbitrary position that is not affected by heat emitted and absorbed by the image forming apparatus itself. For example, a thermistor or a platinum temperature-measuring resistor is used as the temperature sensor, and a polymeric sensor, a metal oxide sensor, or an electrolytic sensor is used as the humidity sensor. In the environment sensor, the temperature sensor and the humidity sensor may be provided in a single unit or separately.

In the image forming apparatus of the fourth embodiment, the type and the surrounding environment of the transfer material are detected with the media sensor and the environment sensor during printing.

Then, the image forming apparatus determines optimum control over Vs between the time T1 and the time T2 on the basis of the detection result, and is fed back to the driving speed of the driving unit 17. More specifically, when the device for detecting the thickness of the transfer material detects that the transfer material is thick, control is performed so that the speed Vt3 of the transfer material at the time (T1+T2)/2 becomes closer to (Vt1+Vt2)/2 than when the device detects that the transfer material is thin. When it is detected that the transfer material is thin, control is performed so that Vt3 becomes closer to Vt2.

Optimum control over Vs is found beforehand in accordance with the combinations of the type and environment of the transfer material.

As described above, in the fourth embodiment, it is possible to more effectively prevent defective image forming caused in a plurality of types of transfer materials in a plurality of environments.

Fifth Embodiment

A configuration and an image forming operation of an image forming apparatus according to a fifth embodiment are substantially identical to those adopted in the image forming apparatus of the first embodiment. Therefore, components having functions similar to those in the image forming apparatus of the first embodiment are denoted by the same reference numerals, and descriptions thereof are omitted.

In the first to fourth embodiments, control is performed so that Vs<Vp at the time T1. This control can solve a problem that becomes more obvious when a margin is not provided at the leading edge of the transfer material in marginless printing. Therefore, when a margin is provided at the leading edge of the transfer material, it is not always necessary to perform control so that Vs<Vp. On the other hand, when the speed Vs at the time T1 is made higher during printing on the transfer material having a margin at the leading edge than during marginless printing, the time necessary for printing can be shortened.

Figure 14:
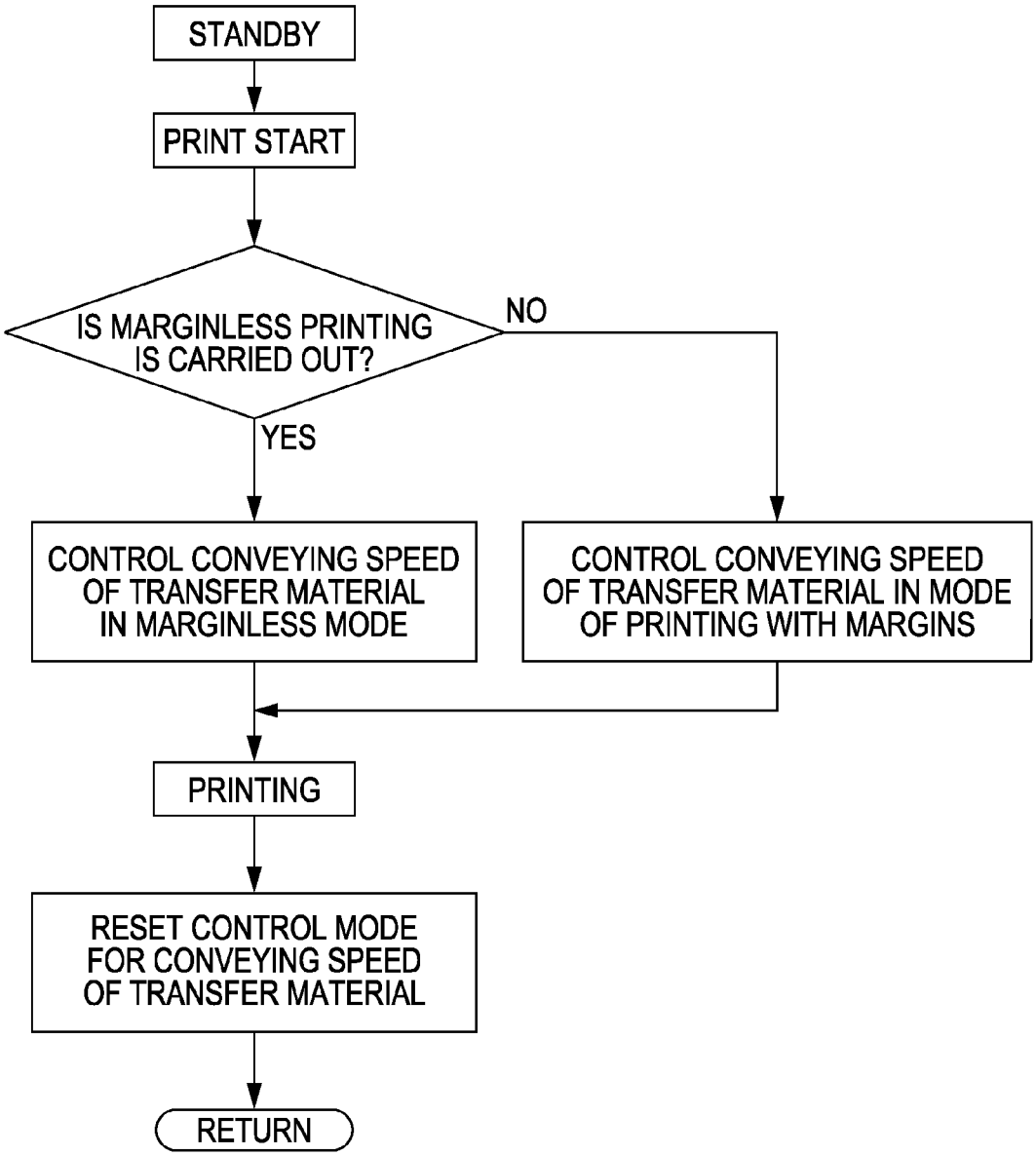
FIG. 14 is a flowchart explaining a fifth embodiment.

In the fifth embodiment, the conveying speed of the transfer material from the time T1 to the time T2 is controlled in different modes between printing on a transfer material having a margin at the leading edge and printing on a transfer material having no margin even at a part of the leading edge, thus enhancing print time efficiency. FIG. 14 is a flowchart showing a procedure performed in the fifth embodiment. When the user carries out marginless printing, one of the control modes for the conveying speed of the transfer material in the first to fourth embodiments is set as a marginless print mode. In contrast, when the user carries out printing on a transfer material having a margin at the leading edge, a control mode for controlling the conveying speed Vs of the transfer material so that Vs=Vp from the time T1 to the time T2 is set as a mode of printing with margins.

Then, the image forming apparatus performs printing according to the set mode. As described above, the fifth embodiment allows printing to be performed in a shorter time period when the user carries out printing on the transfer material having no margin at the leading edge and printing on a transfer material having a margin at the leading edge, than when printing is always performed in the marginless mode.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-115732 filed Apr. 25, 2008, which is hereby incorporated by reference herein in its entirety.

What is claimed is:

1. An image forming apparatus, comprising:

a rotatable image bearing member configured to bear a toner image;

a transfer member configured to form a nip portion between said transfer member and said image bearing member;

a guide member configured to guide a leading edge of a transfer material to an outer surface of said image bearing member on an upstream side of said nip portion in a rotating direction of said image bearing member;

a conveying roller configured to convey the transfer material to said guide member; and a control device configured to control a speed of said conveying roller, wherein the transfer material, being in contact with the image bearing member, is guided by the guide member to the nip portion, and the toner image on said image bearing member is transferred onto the transfer material in said nip portion, wherein said image forming apparatus has a marginless print mode in which the toner image is formed on said image bearing member to a region on said image bearing member corresponding to a region outside the transfer material so as to be formed to an edge of the transfer material, wherein, in a case when the toner image is formed at least at the leading edge of the transfer material in a conveying direction in the marginless print mode, said control device controls the speed of said conveying roller so that a speed of the transfer material, when the leading edge of the transfer material, being guided by the guide member, comes into contact with the image bearing member, is lower than a rotation speed of said image bearing member and the speed of the transfer material increases to be the same as the rotation speed of said image bearing member prior to entering the nip portion, and wherein the speed of the material is increased by satisfaction of the following relationship:

$$(\Delta t)(V_{t2})+(2b/V_p)V-\Delta t+(2b/V_p)(\cos\theta)=0,$$

where $\Delta t$ is a time difference between a beginning of an increase in a speed of the transfer material to a completion of the increase in speed as determined on a basis of a time counted when registration rollers begin to convey the transfer material, $V_{t2}$ is a speed of the transfer material when the leading edge comes into contact with the nip portion, b is a length of a side of a triangle defined by a transfer belt and the transfer material, at the time of the beginning of the increase in the speed of the transfer material and the completion of the increase in speed, which is $\Delta t$, and is a known entered value used by the control device, V is the speed of the transfer material, wherein V is determined by the relationship $V=(V_s/V_p)*100$, where $V_s$ is the a speed at which the transfer material is conveyed by registration rollers and $V_p$ is a linear speed of the transfer belt, both $V_s$ and $V_p$ are controlled by the control device, and $\theta$ is an angle between sides of the triangle.

2. An image forming apparatus according to claim 1, wherein, in the case when said image forming apparatus forms the toner image at least at the leading edge of the transfer material in the conveying direction in the marginless print mode, said control device controls the speed of said conveying roller to be lower than the rotation speed of said image bearing member so that the speed of the transfer material when the leading edge of the transfer material comes into contact with said image bearing member is lower than the rotation speed of said image bearing member.

3. An image forming apparatus according to claim 1, wherein said control device controls the speed of said conveying roller so that the speed of the transfer material when the leading edge of the transfer material, being in contact with the image bearing member, comes into said nip portion is lower than the speed of the transfer material when the leading edge of the transfer material comes into contact with said image bearing member.

4. An image forming apparatus according to claim 3, wherein said control device controls the speed of said conveying roller so that the speed of the transfer material when the leading edge of the transfer material, being in contact with the image bearing member, comes into said nip portion is equal to the rotation speed of said image bearing member.

5. An image forming apparatus according to claim 1, wherein said control device controls the speed of said conveying roller so as to satisfy the following condition:

$$Vt2>Vt3>(Vt1+Vt2)/2$$

where Vt1 represents the speed of the transfer material when the leading edge of the transfer material comes into contact with said image bearing member, Vt2 represents a speed of the transfer material when the leading edge of the transfer material comes into said nip portion, T1 represents a time when the leading edge of the transfer material comes into contact with said image bearing member, T2 represents a time when the leading edge of the transfer material comes into said nip portion, and Vt3 represents a speed of the transfer material at a time (T1+T2)/2.

6. An image forming apparatus according to claim 5, further comprising:

a transfer-material thickness detecting device configured to detect a thickness of the transfer material, wherein said control device sets Vt3 on the basis of a result of detection of said transfer-material thickness detecting device, and performs control so that Vt3 is closer to (Vt1+Vt2)/2 when said transfer-material thickness detecting device detects that the thickness of the transfer material is large than when said transfer-material thickness detecting device detects that the thickness of the transfer material is small.

7. An image forming apparatus according to claim 5, further comprising:

a transfer-material thickness detecting device configured to detect a thickness of the transfer material, wherein said control device sets Vt3 on the basis of a result of detection of said transfer-material thickness detecting device, and performs control so that Vt3 is closer to Vt2 when said transfer-material thickness detecting device detects that the thickness of the transfer material is small than when said transfer-material thickness detecting device detects that the thickness of the transfer material is large.

8. An image forming apparatus according to claim 1, wherein, in the case when the toner image is not formed at the leading edge of the transfer material in the conveying direction in the marginless print mode, said control device controls the speed of said conveying roller so that the speed of the transfer material when the leading edge of the transfer material, being in contact with said image bearing member, comes into said nip portion is equal to the rotation speed of said image bearing member.

9. An image forming apparatus according to claim 1, wherein said transfer member is a rotatable transfer roller.

10. An image forming apparatus according to claim 1, wherein said transfer member is a rotatable belt.

11. An image forming apparatus according to claim 1, further comprising a photosensitive member, wherein the toner image is transferred from said photosensitive member onto said image bearing member.

* * * * *